United States Patent [19]

Beauzamy

[11] Patent Number: 4,945,223

[45] Date of Patent: Jul. 31, 1990

[54] X-RAY IMAGE INTENSIFIER TUBE WITH CIRCUIT TO COMPENSATE FOR THE EFFECTS FO MAGNETIC DISTORTION

[75] Inventor: Jacques Beauzamy, Chatillon, France

[73] Assignee: General Electric CGR S.A., Issy les Moulineaux, France

[21] Appl. No.: 372,903

[22] Filed: Jun. 29, 1989

[30] Foreign Application Priority Data

Jul. 1, 1988 [FR] France ..... 88 08960

[51] Int. Cl.[5] ..... H01J 31/50

[52] U.S. Cl. ..... 250/213 V T; 315/371

[58] Field of Search ..... 315/8, 371; 250/213 V T; 358/111

[56] References Cited

U.S. PATENT DOCUMENTS

| | | | |
|---|---|---|---|
| 3,809,889 | 5/1974 | McBroom | 250/213 V T |
| 4,063,134 | 12/1977 | Iida | 315/371 |
| 4,328,418 | 5/1982 | Morgan et al. | 250/213 V T |
| 4,456,853 | 6/1984 | Robinder et al. | 313/421 |

*Primary Examiner*—David C. Nelms
*Assistant Examiner*—George Beck
*Attorney, Agent, or Firm*—Oblon, Spivak, McClelland, Maier & Neustadt

[57] ABSTRACT

To compensate for the effects of magnetic distortion in an X-ray image intensifier tube, the mode of scanning the target of the television camera associated with this tube is modified. Shifts, corresponding to measured distortions, are caused in the line scan and the vertical scan. In this way, an image which can be used in morphometry is restored on a display screen.

9 Claims, 1 Drawing Sheet

X-RAY IMAGE INTENSIFIER TUBE WITH CIRCUIT TO COMPENSATE FOR THE EFFECTS FO MAGNETIC DISTORTION

BACKGROUND OF THE INVENTION

1. Field of the Invention

An object of the present invention is an X-ray image intensifier tube, especially of the type used in medicine, either in direct radioscopy or in radiology, with digitalized processing of the signal representing the image. The invention more particularly concerns a device to correct the distortion contributed to the image given with instruments of this type.

2. Description of the Prior Art

An X-ray image intensifier tube is designed to receive low-power X-radiation and convert this X-radiation into luminous radiation of higher power, which can be more easily detected by a display means, especially by a television camera. The reason why the X-radiation received is weak has to be related to the concern, especially in medicine, with protecting patients under examination by means of X-radiation of this type. This happens especially when these examinations are lengthy, as is the case with processing operations with digitization of information on image, or as may be the case with future-generation tomodensitometers where the detecting element will be precisely an X-ray image intensifier of this type.

An image intensifier tube essentially has a conversion panel to convert a received X-radiation into a luminous radiation capable of driving a photocathode, placed so as to face this panel. The conversion from X-radiation to light radiation is got in a known way by furnishing the panel with caesium iodide crystals. Under the effect of the illumination, photoelectrons are liberated from the photocathode and move towards a screen. This movement towards the screen is subjected to the action of an electronic lens. This electronic lens tends to make the impact of the photoelectrons on the screen correspond to the position of the photocathode from which they have been emitted. The screen itself is of a particular type. It re-emits a light image representing the electronic image conveyed by the electrons which themselves represent the X-ray image. This light image can then be detected by any display means, particularly by a target of a standard television camera. This light image is written on a face in front of the target while a target reading beam reads the written image on the other face.

A display sequence of this type has a major drawback: the image revealed is one that is geometrically distorted as compared with the X-ray image from which it originates. This distortion occurs essentially between the photocathode, excited by the photons coming from the conversion panel, and the screen which receives the electronic radiation emitted by the photocathode. For, while they are in transit, the photoelectrons are subjected to disturbing effects, especially magnetic effects caused by the earth's magnetic field. If the photoelectrons, while in transit, were all affected by one and the same type of disturbance, then correcting the effect of these disturbances at any point in the sequence of images would be enough to avoid any inconvenience therefrom. Unfortunately, these photoelectrons are highly sensitive, and the non-homogeneity of the magnetic field at the positions through which they pass is such that it results in a distortion of the electronic image projected on the screen. To explain the effects of a distortion of this type in more concrete terms, it can be said that the image of a straight line interposed between an X-ray tube and an image intensifier of this type will be a straight line in the X-ray image which excites the panel; it will be a straight line in the photonic image which drives the photocathode; it will be a straight line in the electronic image which leaves this photocathode, but will no longer be a straight line in the electronic image which gets displayed on the screen. Consequently, it can no longer be a straight line in the light image produced by this screen. The display device which is placed downline thus shows, somewhat, the result of the distortion due to the non-homogeneity of the earth's magnetic field in the space crossed by the electronic image.

Until now, this type of drawback could be overlooked because the images that were sought to be produced were essentially qualitative ones, and because little attention was paid to their quantitative content, namely the exactness with which the contours of the revealed objects were drawn. However, at present, with the development of new techniques, it is increasingly being sought to employ images of this type quantitatively. For example, it might be desired to perform prosthesis on the basis of the images obtained, and, in this case, distorted images would be intolerable. Moreover, in industrial checking, this type of fault makes it impossible to use images intensifiers of this type easily in metrology. In the same way, with future tomodensitometers, this deterioration will prevent accurate reconstruction of simultaneously acquired images of slices.

Various methods, essentially tending to modify the disturbing magnetic field, have been proposed to overcome these drawbacks. In a first set of methods, the image intensifier tube is encased with a magnetic shield. This shield channels the magnetic field lines and reduces the effects of the distortion. However, for reasons related to radiological absorption, a shield of this type cannot be placed above and in the vicinity of the external face of the conversion panel. Consequently, the magnetic distortions continue to exist near this panel. Unfortunately, precisely in the vicinity of this panel, the electrons liberated from the photocathode still have very low speeds. They are therefore very sensitive, at this location, to all the magnetic disturbances.

Besides, following the same line of thinking which led to the use of shields, it has also been proposed to place a magnetic field correction coil near the conversion panel. This coil is wound on the periphery of the panel. The French Patent No. 88 04071, filed on Mar., 29, 1988, even proposed setting up an automatic control link between the current flowing through this coil and a measurement of the component of the magnetic field colinear with the main axis of the image intensifier tube.

It might be thought that this latter technique could be extended to the measurement of the transverse components of the disturbing magnetic field so as to compensate for its effects. However, this method cannot be considered because the correction coils produce correcting magnetic fields that are independent of one another. These coils react on one another in such a way that the overall correction very quickly becomes inextricable. However, the need to take the distortions contributed by the transverse components of the magnetic field into account becomes vitally important inasmuch as it is sought to use the image intensifier tubes for purposes of morphometry. It is also possible to envisage the acquisition of a typical image, distorted by the disturbances, and the deduction therefrom of the corrections to be made to normal images, acquired under the same conditions as that of the typical image. The correction of the distortion in these normal images, based on mathematical algorithms applied by computer programs, is shown to be limited when the volume of information to be processed becomes great. For, this information on distortion is essentially related to the position of the image intensifier tube in space at the moment when it receives an X-radiation to be measured through an object to be X-rayed. Firstly, the very numerous positions possible for an image intensifier tube of this type makes for great bulk in the storage of this information on correction. Secondly, the application of the computed corrections to the normal images, calling for the use of bilinear algorithms (with multiplications), takes long to process if the number of correction bits is great. One method aimed at lightening the task of performing computations of this type consists in limiting the corrective magnitudes to be taken into account. Ultimately, it is sought to limit the number of computation bits. If the result of the computer program correction is considered to be a precise correction of the image distortion, a rough correction of this distortion must be got by other means.

An object of the present invention is to overcome these drawbacks by proposing a simple method which does not bring complicated arrangements of correction coils into play but contributes to a significant reduction in the number of processing bits to be managed. The invention is based on the following observation: the disturbing transverse components of the magnetic field have transverse effects in the created image. In this case, rather than seeking to counter the disturbing magnetic effects of the field, in their distortion of the writing on the television camera target, the method is confined to measuring the existence of these disturbing components and to taking them into account to organize the reading of this target of the television camera. In particular, with the horizontal scan and vertical scan controls of the beam for reading the target of this television camera, it is possible to take into account the original shift as well as modifications, if any, in the range of exploration of the target according to the measurements of these disturbing components.

SUMMARY OF THE INVENTION

An object of the invention, therefore, is an X-ray image intensifier tube comprising:

a conversion panel to convert an X-radiation into an electronic radiation, a screen to convert the electronic radiation into a light radiation, a television camera provided with a target to detect this light radiation, and a circuit to compensate for the distortion effects due to the magnetic disturbances, said circuit comprising:

a circuit to set the reading mode of the television camera target according to a measurement of the magnetic distortion.

BRIEF DESCRIPTION OF THE DRAWINGS

The invention will be better understood from the following description and the accompanying FIGURE. This FIGURE is given purely as an indication and in no way restrict the scope of the invention.

DESCRIPTION OF A PREFERRED EMBODIMENT

Figure 1:
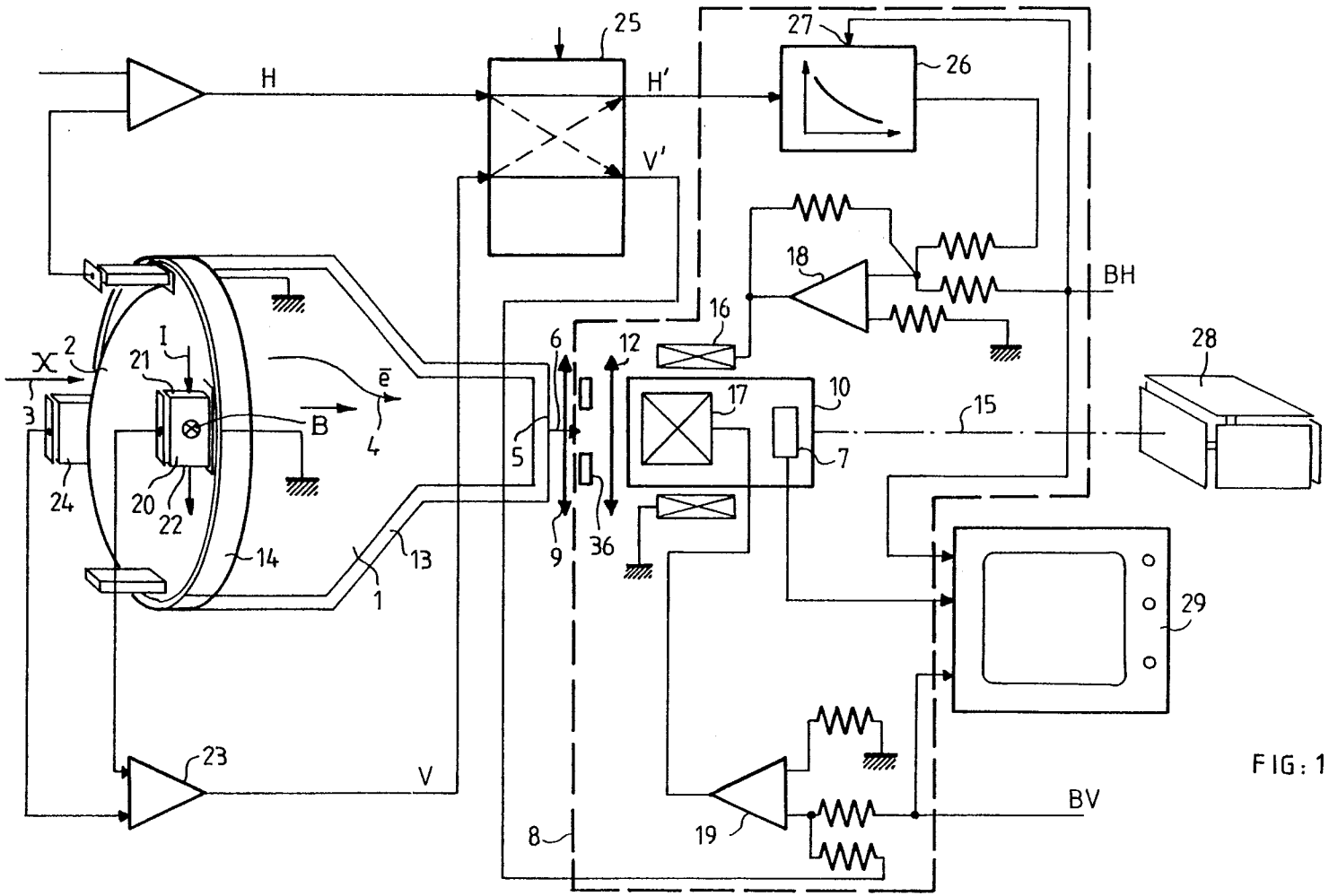

The single FIG. 1 shows an X-ray image intensifier tube furnished with the device of the invention. In this FIGURE, an image intensifier tube 1 has a conversion panel 2 to convert an incident X-radiation 3 into an electronic radiation 4. A screen 5 receives the electronic radiation 4 and converts it into a light radiation 6 which can be detected by a target 7 of a television camera 8. A primary lens 9 is used to send on the image formed on the screen 5 to infinity. From the image at infinity, the secondary lens 12 forms a real image on the target 7 of an analyzer tube 10. Between the two lenses 9 and 12 is interposed a diaphragm 36 used to adjust the light intensity reaching the analyzer tube 10.

The television camera has a deflection unit comprising a vertical deflection coil 17 and a horizontal deflection coil 16. These deflectors are used to scan the target of the analyzer tube by means of an electronic beam. The horizontal deflection circuit receives a horizontal scan signal BH and the vertical deflection circuit receives a vertical scan signal BV. The tube 1 also conventionally has a magnetic shield 13 which encases it as well as a coil 14 for correcting the component, directed along the main axis 15 of the magnetic field, near the input face of the tube 1 where the conversion panel is located.

The invention essentially comprises means to measure the transverse components of the disturbing magnetic field near the tube as well as a circuit to correct the deflection of the target 7 reading beam according to these measurements. There are also other signals present, notably to extinguish the target scanning beam during the scan flybacks. These signals, with their application circuit, are not shown for they do not interfere with the invention. In a preferred application, the corrections applied according to the measurements of the horizontal and vertical disturbances are taken into account in the form of original shifts of the respectively horizontal and vertical scans implicated. To this end, operational amplifiers 18 and 19, mounted with resistors in adder circuits, are provided respectively to add the horizontal shift signals H to the horizontal scan signals BH and the vertical shift signals V to the vertical scan signals BV.

The signals H and V representing the shifts to be applied, corresponding to the magnetic disturbances, are advantageously obtained by probes of the Hall effect type, such as the probe 20. These probes have a parallelepiped shape, and a biasing current I given by a generator (not shown) flows through them between two opposite faces 21 and 22. These probes, subjected to an external induction B (which moves away from the plane of the FIGURE as indicated by the tail of the arrow) perpendicular to the direction in which the current I flows, develop a potential difference between the other faces of the parallelepiped perpendicular to this field. This potential difference is proportionate to the amplitude of the measured component B. This potential difference is detected and, after passing through a correction amplifier 23 if necessary, it is applied as a signal representing the disturbance measured at the shift circuit comprising the operational amplifiers, 18 and 19 respectively. So as to allow for manufacturing variations in the probes such as 20, and also for differences in the value of the field measured on either side of the conversion panel 2, it is preferable to match the probes. Thus the probe 22 is matched with a probe 24, the signal delivered by these two probes being combined in the amplifier 23.

Rather than applying the measured signals, H and V, directly in the shift circuits, there may be provision for an axis changing circuit 25 wherein, as shown with dashes, the signal H is applied by way of a shift correction of the vertical scan, while the signal V would be applied as a correction of the horizontal scan. This circuit 25 may be warranted notably when, for manufacturing reasons, it may be necessary, at the last moment, to modify the position of the image intensifier screen 1 with respect to the television camera 8. However, the circuit 25 may be valuable in another way: it can make it possible to take warp corrections into account. In a more complicated embodiment, the signals H and V are converted into signals H' and V' such that:

$$H' = aH + bV$$

$$V' = a'H + b'V$$

with $a^2 + b^2 = 1$ and $a'^2 + b'^2 - 1$

This amounts to making an axis change in the corrections to be assigned and, ultimately, makes it possible to take every situation into account, in particular the various positions that the television camera can occupy with respect to the image intensifier tube.

Furthermore, to correct the range, a circuit 26 can be introduced on each of the channels H and V, enabling the correction of the shift at its origin depending on the scanning position of the target reading beam. Although, in a preferred embodiment, the circuit 26 will be omitted, this circuit 26 shows that it is possible to obtain a range correction (of order 1 or more) in the reading range. The circuit 26 gives a shift at the original point which is variable with time. In digital mode, this circuit 26 may consist of a set of pre-programmed memory registers. Of course, the circuit 26 has a zero-setting input 27 to synchronize it with the scanning signal considered.

In a preferred application, and taking space factor considerations into account, the Hall effect probes will be combined in a cubical type of assembly (a six-sided cube with one probe on each face) so that all three disturbing components of the magnetic field are examined by one compact device. Preferably, the cubical device 28 will even be placed at the rear and on the axis 15 of the tube 1.

A display monitor 29 makes it possible, once the corrections are made, to depict images acquired during a radiology experiment in such a way that these images are precisely centered and are consistent with their real dimensions. This image, displayed or even memorized, can be used for purposes of morphometry or reconstruction of tomodensitometry images.

What is claimed is:

1. An X-ray image intensifier tube comprising:

a conversion panel to convert an X-radiation into an electronic radiation, a screen to convert the electronic radiation into a light radiation, a television camera provided with a target to detect the light radiation, means for measuring magnetic disturbances, and a and a circuit to compensate for distortion effects due to the magnetic disturbances, said circuit comprising:

a circuit to set the reading mode of the television camera target according to the measurement of the magnetic distortion.

2. A tube according to claim 1 wherein the setting circuit comprises Hall effect probes.

3. A tube according to claim 2 wherein the probes are placed in the axis of the tube.

4. A tube according to claim 2 or 3 wherein the probes are mated.

5. A tube according to claim 2 or 3 wherein the probes are mounted as a cube.

6. A tube according to claim 2 or 3 wherein the probes are mounted against a coil for correcting the effects of the longitudinal component of the disturbing magnetic field.

7. A tube according to claim 2 or 3 wherein the setting circuit comprises a circuit to combine the measurements of the effects of the various disturbing magnetic components.

8. A tube according to claim 7 wherein the combining circuit comprises a circuit to make a change in axis of correction directions.

9. A tube according to claim 7 wherein the combining means comprise a circuit to modify the scan mode according to the range of the distortion.

* * * * *

UNITED STATES PATENT AND TRADEMARK OFFICE

CERTIFICATE OF CORRECTION

PATENT NO. : 4,945,223

DATED : JULY 31, 1990

INVENTOR(S) : JACQUES BEAUZAMY

It is certified that error appears in the above-identified patent and that said Letters Patent is hereby corrected as shown below:

Title page:

In the title, please delete "THE EFFECTS FO MAGNETIC DISTORTION" and insert --THE EFFECTS OF MAGNETIC DISTORTION--.

Signed and Sealed this

Twenty-eighth Day of January, 1992

*Attest:*

HARRY F. MANBECK, JR.

*Attesting Officer*

*Commissioner of Patents and Trademarks*